United States Patent [19]

Bischeri

[11] 4,175,358

[45] Nov. 27, 1979

[54] PLUNGE-GRINDER, ESPECIALLY FOR GRINDING THE CAMS OF ENGINE TIMING SHAFTS

[76] Inventor: Ido Bischeri, Via F.lli Rizzi 1, Proserpio (Como), Italy

[21] Appl. No.: 860,930

[22] Filed: Dec. 15, 1977

[51] Int. Cl.[2] ..... B24B 17/00

[52] U.S. Cl. ..... 51/142; 51/145 R

[58] Field of Search ..... 51/101 R, 145 R, 50 PC, 51/142, 148

[56] References Cited

U.S. PATENT DOCUMENTS

| | | | |
|---|---|---|---|
| 1,622,755 | 3/1927 | Asbridge | 51/101 X |
| 1,813,503 | 7/1931 | Merryweather | 51/101 R X |
| 1,843,301 | 2/1932 | Player et al. | 51/101 R |
| 2,508,998 | 5/1950 | Green | 51/101 R |
| 2,553,831 | 5/1951 | Musyl | 51/50 PC X |
| 3,760,537 | 9/1973 | Bovati | 51/145 R |
| 3,797,176 | 3/1974 | Wespi | 51/101 R |
| 3,925,937 | 12/1975 | Stevens et al. | 51/101 R X |

*Primary Examiner*—Harold D. Whitehead
*Assistant Examiner*—Robert P. Olszewski
*Attorney, Agent, or Firm*—Karl W. Flocks

[57] ABSTRACT

A grinding machine operating according to the plunge principle is disclosed, in which a plurality of machining units, each independent of the remaining ones, are mounted on a translatable table. If, for instance, a camshaft must be plunge-ground, each cam of a pattern piece is sensed by an independent sensing means and a grinding unit is approached to the cam of the workpiece and grinding is completed until the sensing means have indicated that the desired dimension has been attained.

4 Claims, 4 Drawing Figures

PLUNGE-GRINDER, ESPECIALLY FOR GRINDING THE CAMS OF ENGINE TIMING SHAFTS

The evergrowing request for reduced working times in the grinding operations has led to an ever more frequent adoption of the so-called plunge grinding method to replace the conventional grinding procedure in consecutive passes.

This requirement of obtaining shorter and shorter grinding times is especially felt in the grinding of cams on the timing shafts of engine which have heretofore been ground one at a time or, at the most, pairwise by adopting intricate grinding machines equipped with two machining heads.

The object of the present invention is to provide a plunge grinding machine which permits to grind simultaneously all the eccentrics or cams which are present on a timing shaft of engines.

Having this object in view, it has been envisaged, according to the present invention, to provide a plunge grinding machine which is characterized in that it comprises, in combination:

a baseplate carrying a table which can be reciprocated with respect to the baseplate itself, supporting means on such table which are adapted to support the workpiece to be ground, a stationary cross-piece mounted on the baseplate behind such table and carrying a plurality of machining units comprising tool-carrying heads confrontingly mounted on such table and reciprocable, the one independently of the other, and driven by sensing means operatively connected to a pattern workpiece from which the piece to be ground is to be copied, motive means and drive-transfer means being provided which are adapted to rotate the workpiece to be ground and the pattern piece in exact phase relationship the one relative to the other.

According to a preferred embodiment of the invention, each machining unit comprises a central supporting member which is position-adjustably affixed on the cross-piece, two rigidly interconnected heads, i.e. a front and a rear head, being properly guided for translation on said supporting member, a lap of an abrasive tape being held taut in closed loop on the front head and running about a motive sheave and a jockey pulley, whereas the rear head carries an idle roller which runs in follower-contact relationship on the respective cam of the pattern piece.

The structural and functional features of the invention along with its advantages over the prior art will become still more conspicuous from the scrutiny of the exemplary disclosure given hereinafter with reference to the accompanying drawings, wherein.

Figure 1:
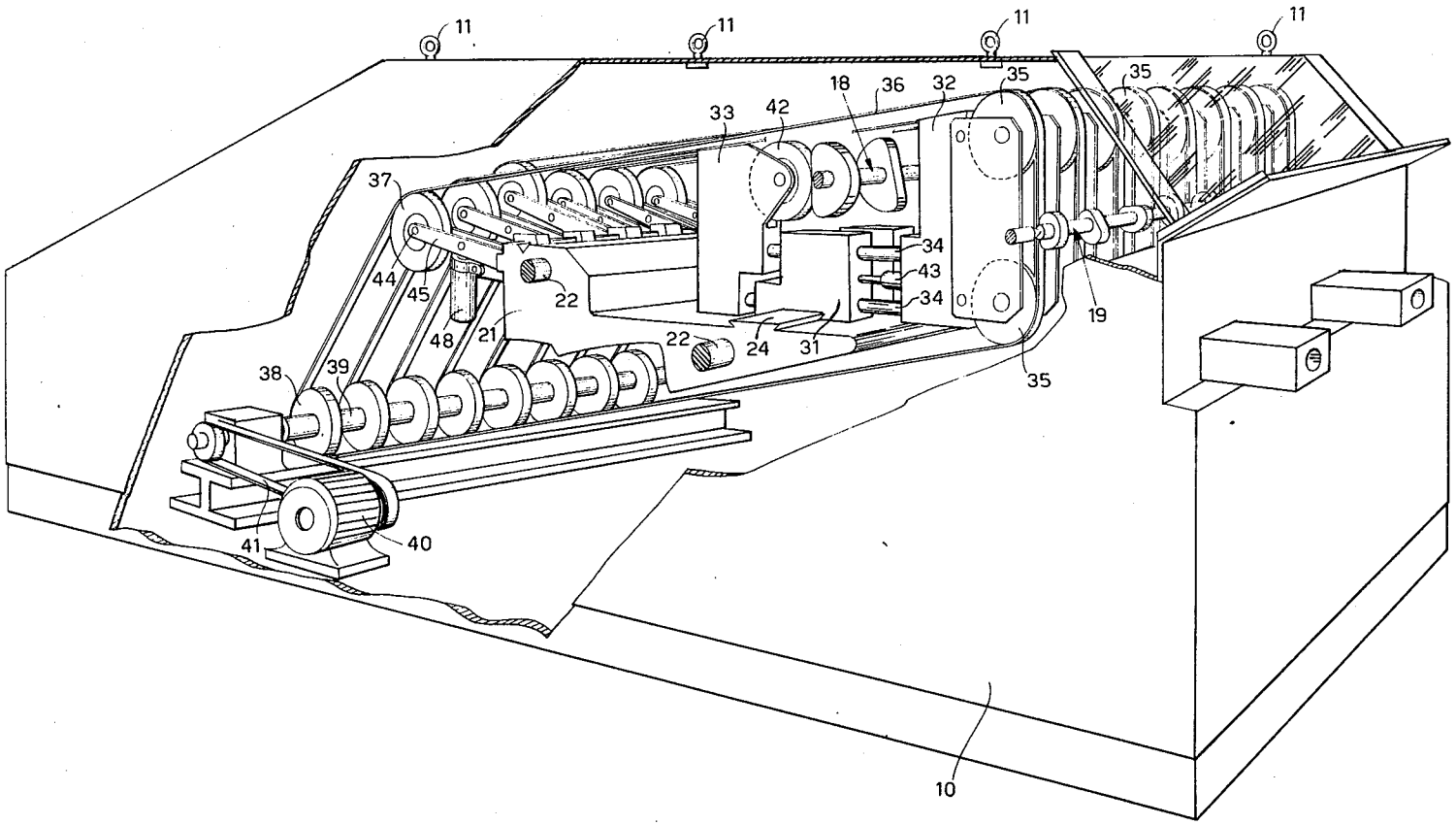
FIG. 1 is a partially outway perspective view embodied according to this invention.

In the drawings, the numeral 10 connotes the baseplate of the plunge grinding machine according to the present invention.

The baseplate 10, which is made of an oversized and self-supporting steel sheet piece, does necessitate to be anchored to the ground but requires a satisfactory leveling by means of antivibratory supporting heels when being assembled.

Properly formed accurately machined pieces provide such a leveling in a conventional way, and are not shown herein in order to simplify both the specification and the drawings.

The task of the baseplate, in addition to that of containing all the mechanical, hydraulic, hydrodynamic and electric means which are required for the operation of the machine, is to ensure, by the agency of appropriate cowlings which are shaped and fitted to the open portions of the baseplate, a perfect seal against the coolant and the vapors evolved therefrom during machining.

Four eyebolts, 11, positioned at four elevated corners of the baseplate permit a convenient lifting and transportation of the machine.

Figure 2:
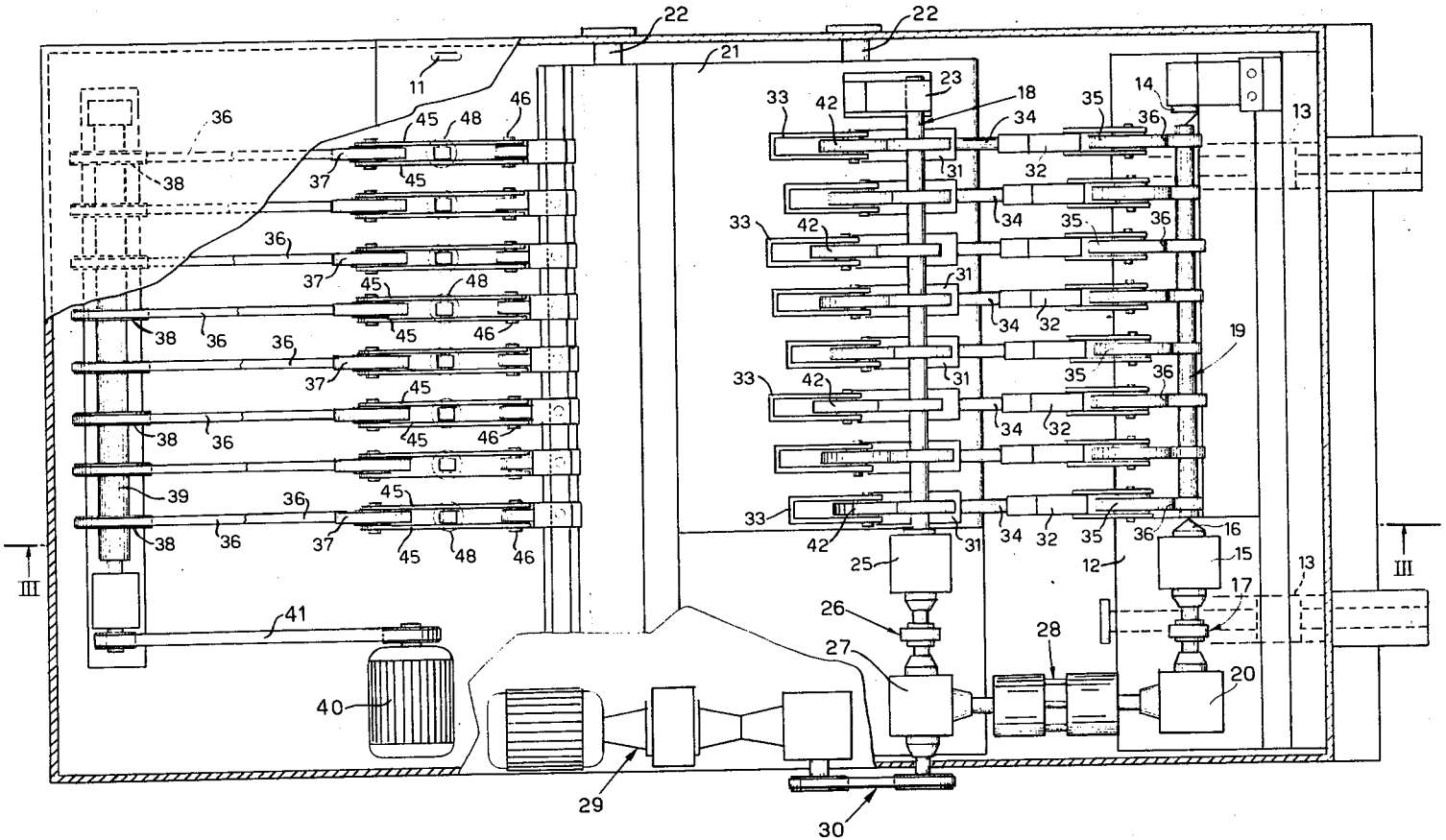
FIG. 2 is a plan view of the machine shown in FIG. 1.
Figure 3:
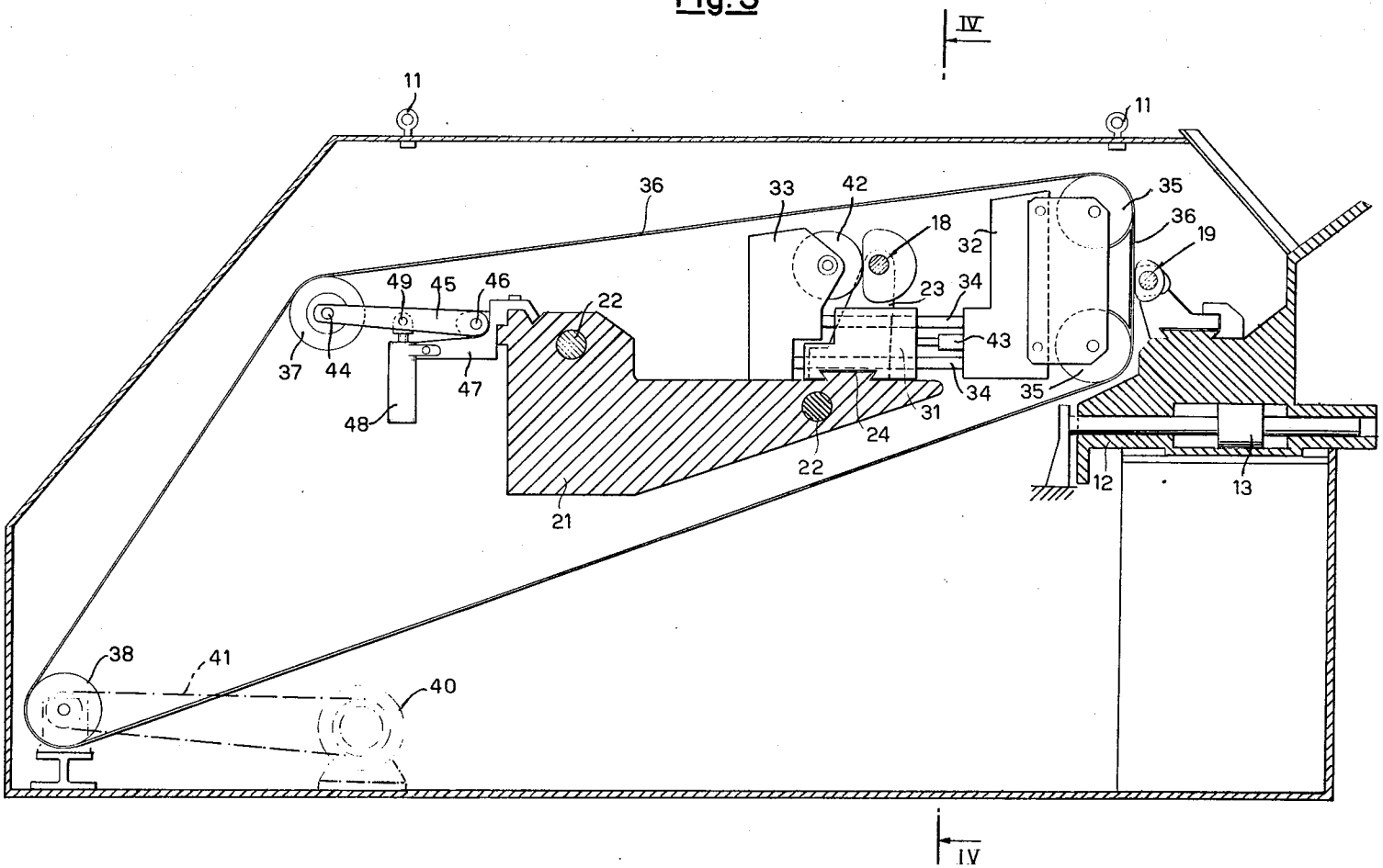
FIG. 3 is a cross-sectional view taken along the line III—III of FIG. 2.
Figure 4:
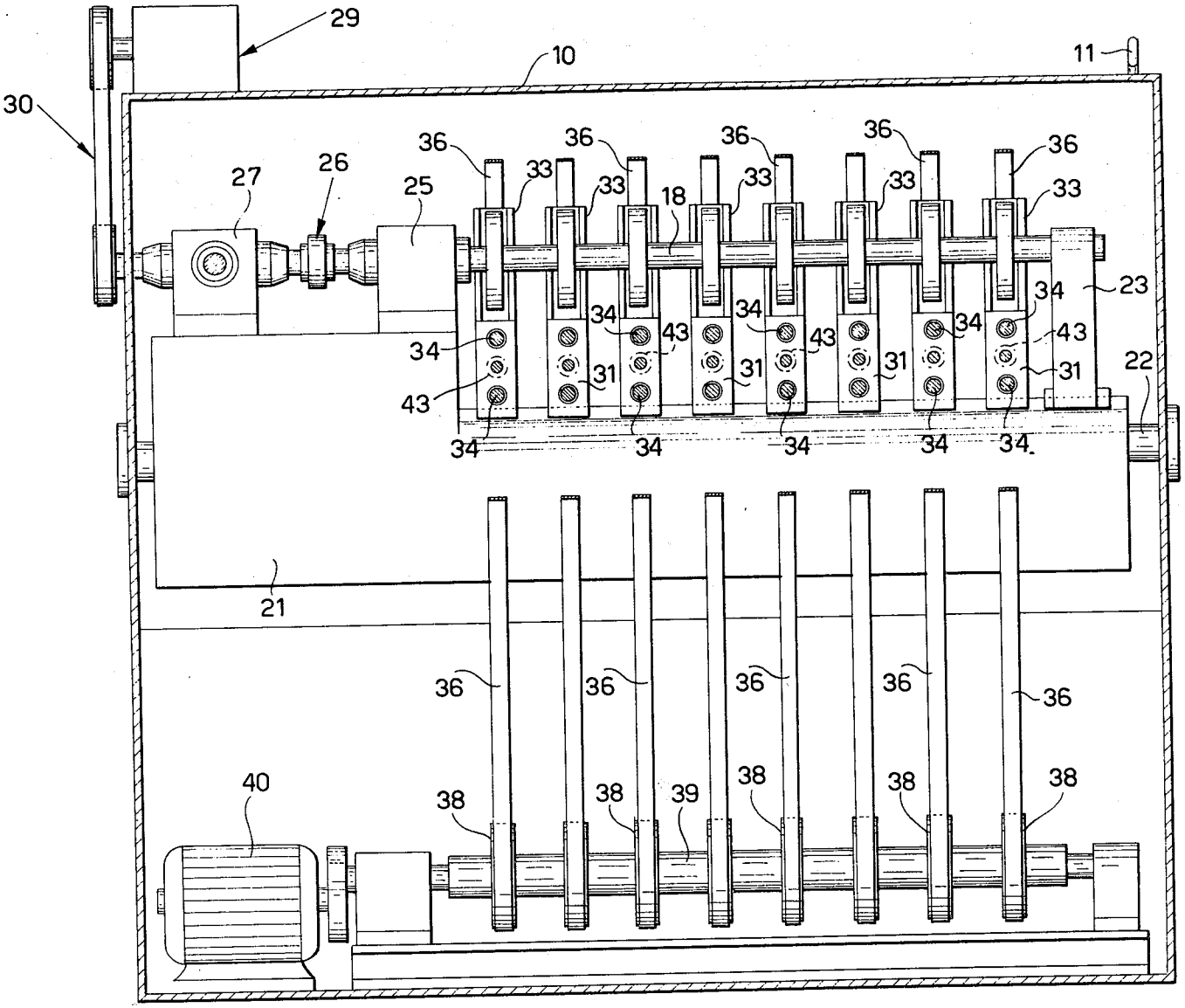
FIG. 4 is a cross-sectional view taken along the line IV—IV of FIG. 3.

The numeral 12 indicates the piece-holding movable table of the machine and is shown in FIGS. 2 and 3 of the drawings.

The table 12, which is housed in the interior of the baseplate in the top front portion of the machine, can slide transversally of the baseplate by the agency of an appropriate set of guideways, the motions and their speeds being hydrodynamically controlled by jacks 13 which provide the three usual strokes of the tables of plunge grinding machines, namely a rapid approach stroke towards the workpiece, a machining stroke proper (advance), and a rapid return stroke.

The table 12 is intended for mounting thereon the workpiece, more particularly a camshaft 19 clamped between a motive head, 15, fitted with a spindle 16, and a tailstock 14. The spindle 16, obviously, will be adapted to withstand the tailstock 14 thrust: the tailstock 16 can be of the hydrodynamic opening and closing type with a control for the clamping force.

At 21, the cross-piece of the machine is shown. The cross-piece 21 is located nearly halfway across the baseplate and rigidly connected on a side thereof while being sustained on the other side by a set of normally active hydrodynamic pins 22, which enable the cross-piece to have the necessary stiffness and accuracy in position (FIGS. 2 and 3).

On the cross-piece 21 are mounted an idle head 23 which is fastened to a dovetail-machined portion 24 of the cross-piece 21, and a motive head 25. Between the heads 23 and 25 a pattern camshaft 18 is positioned, which is the sample from which to copy the camshaft to be ground.

As best shown in FIG. 2 of the drawings, the motive heads 15 and 25 are driven to rotation by a single driving, speed-varying and reducing unit 29 which is connected to such heads by a drive-transfer mechanical linkage in the following manner.

The motive heads 15, 25 are connected to 90-degree transmissions 20, 27 via the respective phasing couplings 17 and 26. The phasing couplings 17, 26 are of the kind adapted to transfer a rotary drive while concurrently providing an accurate phase-relationship between the shafts 18 and 19. The confrontingly mounted axles of the transmissions 20 and 27 are operatively interconnected by a coupling having an extreme radial accuracy (no-clearance) which is generally indicated at 28. The coupling 28, for instance, is of the front-dog type and must be telescopable on account of the reciprocal motion of the table 12. The drive is transferred from the unit 29 to the input shaft of the transmission 27 through a transmission 30. It should be noted that, to this purpose, the 90-degree transmission 27 has three axles, whereas the transmission 20 has only two.

All of these component parts of the mechanical transmission linkage from the motive unit 29 to the shafts 18, 19 are not described and shown in detail herein inasmuch as they can be of any conventional make well known to those skilled in the art.

On the cross-piece 21, in addition, there are mounted a plurality of machining units, i.e. as many as there are cams on the camshaft to be ground. Each machining unit comprises a stationary central supporting member, 31, which is mounted adjustably as to its position on the dovetail 24. On the supporting member 31 two heads 32, 33 are translatable, front and rear head, respectively, and are rigidly mutually connected by the agency of a couple of guideways 34.

The head 32 carries a couple of idle rollers 35, having parallel axles and between which is held taut a straight vertical lap of an abrasive tape 36 which is wrapped in closed loop about a respective jockey pulley 37 and a respective sheave 38, the latter being keyed to a shaft 39 driven by a motor 40 via a transmission 41.

As can best be seen in FIG. 3 of the drawings, each jockey pulley 37 is idly supported at 44 by one end of an arm 45, the arm being pivoted at the opposite end, at 46, to a supporting bracket 47: such bracket is secured to the cross-piece 21.

A hydraulic single-acting jack 48 is active between the bracket 47 and an intermediate point 49 of the arm 45 which is the pivotal point and urges the jockey pulley 37 constantly into touch with the abrasive tape 36. By so doing, the length variations of the grinding-tape sections held taut betweeen the driving sheaves 38 and the jockeys 37 and between the jockeys and the rollers 35 are taken up.

The head 33 carries an idle roller 42 which is constantly urged against the relevant cam of the pattern shaft 18 by a single-acting hydraulic jack 43, which is active between the stationary supporting member 31 and the front head 32.

The operation of the grinding machine according to the present invention will clearly appear from the foregoing and the figures of the drawings: it is, briefly, summarized, the following.

The shaft to be ground, 19, and the pattern shaft 18 are placed on the table 12 and the cross-piece 21 in accurate phase relationship with respect to one another by the agency of the phasing couplings 17 and 26.

The table 12 is caused to advance so as to bring the cams of the camshaft 19 in machining contact with the respective abrasive tapes of the grinding heads 32 which will be correctly positioned to receive the cams: the correct position is determined by the sensing rollers 42 which are urged by the jack 43 in cam-follower contact with the corresponding cams of the pattern shaft 18. The shafts 18 and 19 are driven to rotation, such as the grinding tapes 36: these will grind the cams of the shaft 19 which are constantly urged thereagainst by the progressive traverse of the table 12 as driven by the jacks 13 in its slow machining stroke. During this machining stage, each machining unit will be moved independently of the others, in reciprocation, on the stationary supporting piece 31, each of such units being moved by the respective cam of the pattern shaft 18 which is active on the sensing roller 42. The roller 42 is kept in constant contact therewith by the relevant jack 43. By so doing, the cams of the shaft 19 can be accurately ground at each and every point coherently with the cams of the pattern shaft 18.

No detail has been given herein as to the coolant loop for the grinding tapes, or as to the hydraulic circuitry for controlling all the component parts, since these parts can be of any conventional make as known by anyone skilled in the art.

While the invention has been described and illustrated in connection with an exemplary embodiment thereof, it will be understood that modifications and changes can be introduced therein without departing from the scope of the invention as defined in and by the appended claims.

I claim:

1. A plunge-type grinding machine for grinding cams of a camshaft comprising a baseplate having a front end and a rear end, a table with means for rotatably supporting a camshaft, means adjustably securing said table on said baseplate to facilitate movement of said table in a direction perpendicular to the axis of a camshaft to be rotatably supported thereon, a stationary cross-piece mounted on said baseplate and having means for rotatably supporting a pattern piece generally parallel to the camshaft with cams to be ground, motive and drive-transfer means for rotating the camshaft with cams to be ground and the pattern piece in phase with each other, and a plurality of independent machining units carried by said cross-piece, said machining units being equal in number to that of the cams of the camshaft to be subjected to a grinding operation, each of said independent machining units including a front head, a rear head, and a central supporting member disposed between said front and rear heads associated therewith, said front and rear heads being rigidly connected to each other by bars passing through one of said central supporting members in reciprocating sliding relationship therewith and extending perpendicular to the axis of a camshaft to be subjected to a grinding operation whereby said front and rear heads of each of said independent machining units may be moved toward and away from a camshaft to be subjected to a grinding operation, each of said rear heads carrying an idle roller and the respective central supporting member associated therewith being movable parallel to the axis of the camshaft to be subjected to a grinding operation whereby said idle rollers may be maintained in cam-follower relationship with cam sections of the pattern piece and thus move said independent machining units toward and away from the cams of a camshaft in a controlled manner, each of said front heads carrying pair of idler pulleys, pulley means disposed at the rear end of said baseplate, a grinding tape extending in a closed loop around said pair of idler and said pulley means to present a tightened rectilinear section at the front end to perform a cam grinding operation, hydraulic-jack means for thrusting said front and rear heads towards a machining position in which the respective idle rollers are in cam-follower contact with corresponding cam sections of the pattern piece and the rectilinear sections of the respective grinding tapes are in machining contact with a corresponding cam of a camshaft to be ground.

2. A grinding machine according to claim 1, characterized in that said idle rollers are each maintained in contact with the respective cam of the pattern piece by said hydraulic jack means acting between said central supporting member and said front head.

3. A grinding machine according to claim 1, characterized in that said pulley means includes a jockey pulley which is thrust by a hydraulic jack into constant contact with said grinding tape.

4. A grinding machine according to claim 1, characterized in that the camshaft to be ground and said pattern piece are rotated in accurate phase relationship with one another when mounted, each, between a motive head and a tailstock, the two motive heads being connected via phasing couplings to respective 90-degree transmission the confrontingly mounted shaft of which are operatively interconnected by a telescopable coupling, one of said 90-degree transmission having three axles one of which is operatively connected via a transmission to a driving, speed-varying and reducing gear unit.

* * * * *